US008938083B2

(12) United States Patent
Liang

(10) Patent No.: US 8,938,083 B2
(45) Date of Patent: Jan. 20, 2015

(54) FIXING MECHANISM FOR FIXING A SOUND BOX AND RELATED ELECTRONIC DEVICE

(75) Inventor: Chen-Yi Liang, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 381 days.

(21) Appl. No.: 13/429,447

(22) Filed: Mar. 26, 2012

(65) Prior Publication Data

US 2013/0010994 A1 Jan. 10, 2013

(30) Foreign Application Priority Data

Jul. 7, 2011 (TW) ..... 100124021 A

(51) Int. Cl.
*H04R 1/02* (2006.01)
*A47B 81/06* (2006.01)

(52) U.S. Cl.
CPC ..... *H04R 1/025* (2013.01)
USPC ..... 381/332; 381/87; 181/199

(58) Field of Classification Search
CPC ..... H04R 5/00; H04R 5/002; H04R 1/025; H04R 1/026
USPC ..... 381/332, 334, 386, 394, 411; 361/818; 455/575.1
See application file for complete search history.

(56) References Cited

U.S. PATENT DOCUMENTS

| | | | | |
|---|---|---|---|---|
| 8,111,867 | B2 | 2/2012 | Wu | |
| 2005/0152569 | A1 * | 7/2005 | Ono et al. | 381/332 |
| 2009/0169046 | A1 * | 7/2009 | Wu | 381/394 |

FOREIGN PATENT DOCUMENTS

| | | |
|---|---|---|
| CN | 101472203 A | 7/2009 |
| TW | M357635 | 5/2009 |
| TW | 201002086 | 1/2010 |

OTHER PUBLICATIONS

Office action mailed on Jul. 3, 2014 for the Taiwan application No. 100124021, filing date Jul. 7, 2011, p. 1 line 14, p. 2 and p. 3 line 1~6.
Office action mailed on Jul. 21, 2014 for the China application No. 201110201390.5, p. 3 line 4~24 and p. 4 line 1~6.

* cited by examiner

*Primary Examiner* — Vivian Chin
*Assistant Examiner* — Ammar Hamid
(74) *Attorney, Agent, or Firm* — Winston Hsu; Scott Margo

(57) ABSTRACT

A fixing mechanism for fixing a sound box on a casing is disclosed in the present invention. The fixing mechanism includes a first bridging structure disposed on the sound box and surrounding a speaker of the sound box, a second bridging structure disposed on the casing and surrounding a sound hole on the casing, a rib structure disposed on the casing, and a damping structure installed between the first bridging structure and the second bridging structure. The damping structure includes a base for contacting against the rib structure, an exterior portion disposed on an outer edge of the base for installing inside the second bridging structure, and an interior portion disposed on an inner edge of the base. An accommodating space is formed between the exterior portion and the interior portion for accommodating the first bridging structure.

15 Claims, 6 Drawing Sheets

FIXING MECHANISM FOR FIXING A SOUND BOX AND RELATED ELECTRONIC DEVICE

BACKGROUND OF THE INVENTION

1. Field of the Invention

The present invention relates to a fixing mechanism for fixing a sound box, and more particularly, to a fixing mechanism for stably fixing a sound box on the casing and a related electronic device.

2. Description of the Prior Art

A screw is utilized to fix a sound box on a casing in the conventional sound box assembly. However, cost of the screw is expensive, and the screw made of rigid material does not absorb vibration generated from the sound box effectively. In addition, the screw and a vibration-absorbing gasket are utilized in the other conventional sound box assembly, which can not ensure that the screw can accurately lock on the sound box as passing through the vibration-absorbing gasket. The vibration-absorbing gasket is deformed by the screw when the screw inserts into a hole on the sound box incorrectly, and the vibration generated from the sound box transmits outward via deformation of the vibration-absorbing gasket. Therefore, design of a fixing mechanism has advantages of low cost, easy assembly and preferable vibration-absorbing function for stably fixing the sound box on the casing is an important issue of the electronic industry.

SUMMARY OF THE INVENTION

The present invention provides a fixing mechanism for stably fixing a sound box on the casing and a related electronic device for solving above drawbacks.

According to the claimed invention, a fixing mechanism includes a first bridging structure disposed on a sound box and surrounding a speaker of the sound box, a second bridging structure disposed on a casing and surrounding a sound hole on the casing, a rib structure disposed on the casing, and a damping structure disposed between the first bridging structure and the second bridging structure. The damping structure includes a base for contacting against the rib structure, an exterior portion disposed on an outer edge of the base for installing inside the second bridging structure, and an interior portion disposed on an inner edge of the base. An accommodating space is formed between the exterior portion and the interior portion for accommodating the first bridging structure.

According to the claimed invention, a part of the exterior portion is disposed inside the second bridging structure.

According to the claimed invention, the first bridging structure comprises a protruding portion, the damping structure further comprises a sheathing portion connected to the exterior portion, and the sheathing portion is for sheathing the protruding portion of the first bridging structure.

According to the claimed invention, the second bridging structure comprises an accommodating portion, the damping structure further comprises a sheathing portion connected to the exterior portion, and the accommodating portion is for accommodating the sheathing portion of the damping structure.

According to the claimed invention, the first bridging structure comprises a protruding portion, the second bridging structure comprises an accommodating portion, the damping structure further comprises a sheathing portion connected to the exterior portion, the sheathing portion is for sheathing the protruding portion of the first bridging structure, and the accommodating portion is for accommodating the sheathing portion of the damping structure.

According to the claimed invention, the first bridging structure comprises a guiding portion, the guiding portion is for partly contacting against the exterior portion and the interior portion when the first bridging structure is accommodated inside the accommodating space.

According to the claimed invention, the guiding portion of the first bridging structure is an inclined structure.

According to the claimed invention, an electronic device includes a casing, and a sound hole is formed on a surface of the casing. The electronic device further includes a sound box comprising a speaker, and sound generated by the speaker transmits out of the casing via the sound hole. The electronic device further includes a fixing mechanism for fixing the sound box on the casing. The fixing mechanism includes a first bridging structure disposed on a sound box and surrounding a speaker of the sound box, a second bridging structure disposed on a casing and surrounding a sound hole on the casing, a rib structure disposed on the casing, and a damping structure disposed between the first bridging structure and the second bridging structure. The damping structure includes a base for contacting against the rib structure, an exterior portion disposed on an outer edge of the base for installing inside the second bridging structure, and an interior portion disposed on an inner edge of the base. An accommodating space is formed between the exterior portion and the interior portion for accommodating the first bridging structure.

Screws are useless in the fixing mechanism of the present invention. The prevent invention connects the first bridging structure and the second bridging structure to the damping structure for stably fixing the sound box on the casing. Because the fixing mechanism of the present invention is disposed between the sound hole on the casing and the speaker of the sound box, sound generated by the sound box can transmit out of the sound hole on the casing through the first bridging structure, the second bridging structure and the damping structure of the fixing mechanism, so that the fixing mechanism of the present invention can increase sound quality of the electronic device. In addition, the damping structure of the present invention can be a buffer between the sound box and the casing, so as to effectively isolate the vibration generated by the sound box for preventing operation of the other electronic components of the electronic device from damage by the vibration generated by the sound box.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
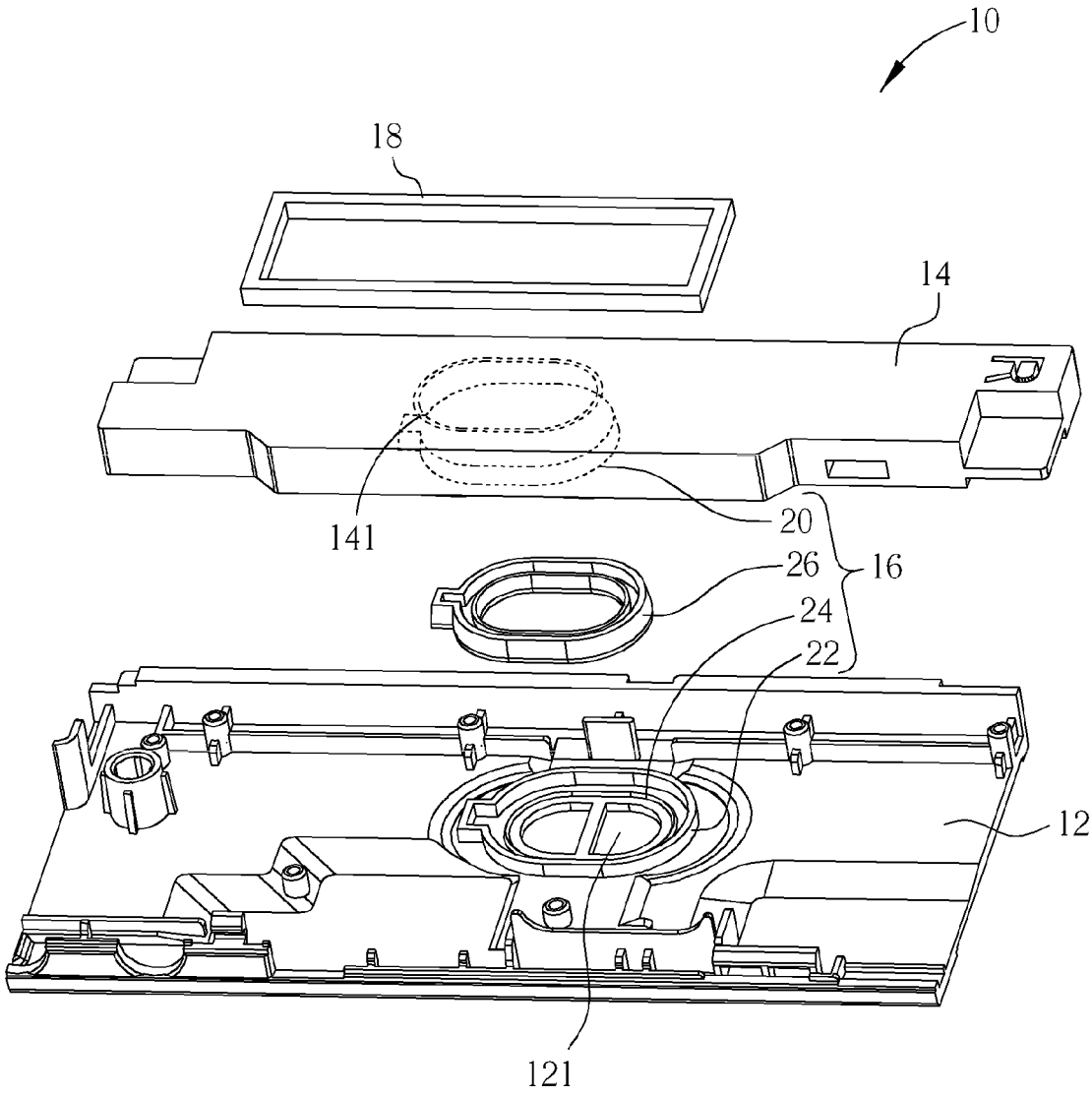
FIG. 1 is an exploded diagram of an electronic device according to an embodiment of the present invention.

Please refer to FIG. 1. FIG. 1 is an exploded diagram of an electronic device 10 according to an embodiment of the present invention. The electronic device 10 includes a casing 12, and a sound hole 121 is formed on a surface of the casing 12. The electronic device 10 further includes a sound box 14, the sound box 14 includes a speaker 141, and sound generated by the speaker 14 can transmit out of the casing 12 via the sound hole 121 on the casing 12. The electronic device 10 further includes a fixing mechanism 16 for fixing the sound box 14 on the casing 12, and a vibration-absorbing component 18 disposed on the sound box 14. The vibration-absorbing component 18 can be made of soft material, such as foam, for absorbing vibration generated from the sound box 14, so as to prevent operation of the other electronic components from damage by the vibration transmitting through the casing 12, and further to prevent the sound box 14 from being inclined by the vibration.

Figure 2:
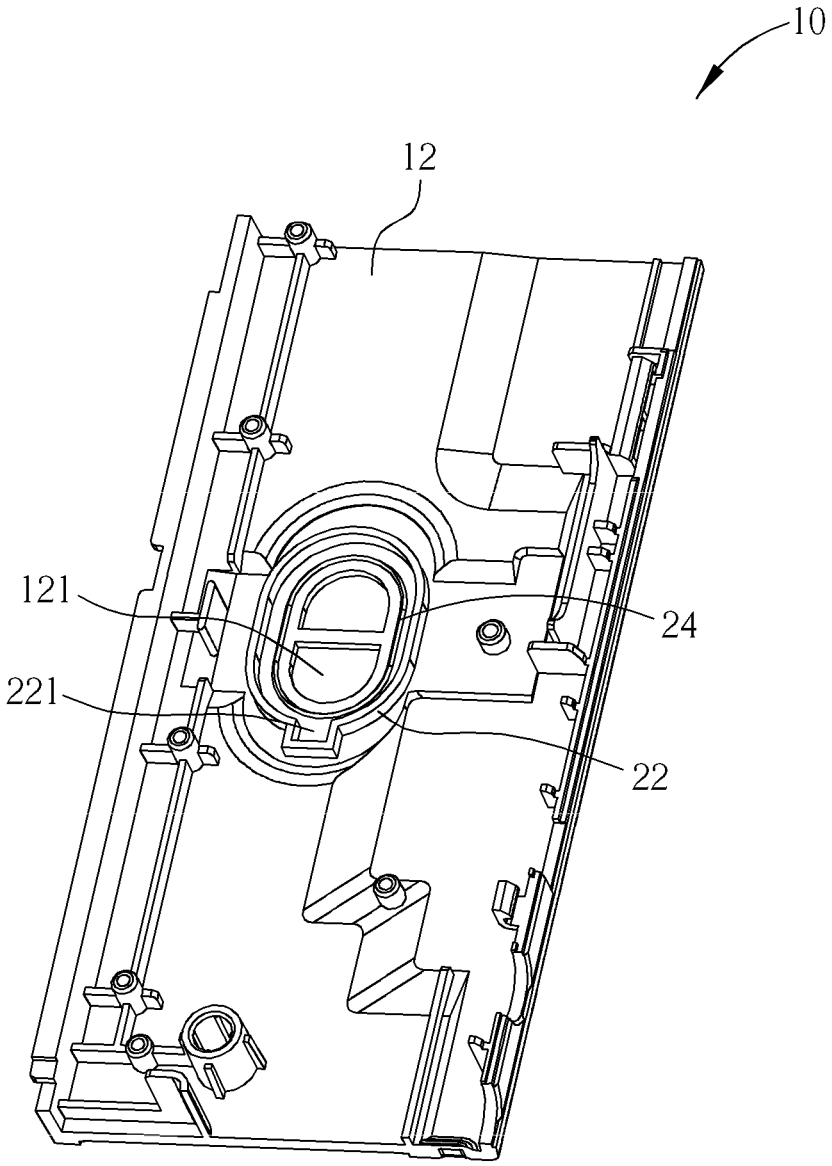
FIG. 2 and FIG. 3 are diagrams of a casing and a sound box according to the embodiment of the present invention.
Figure 3:
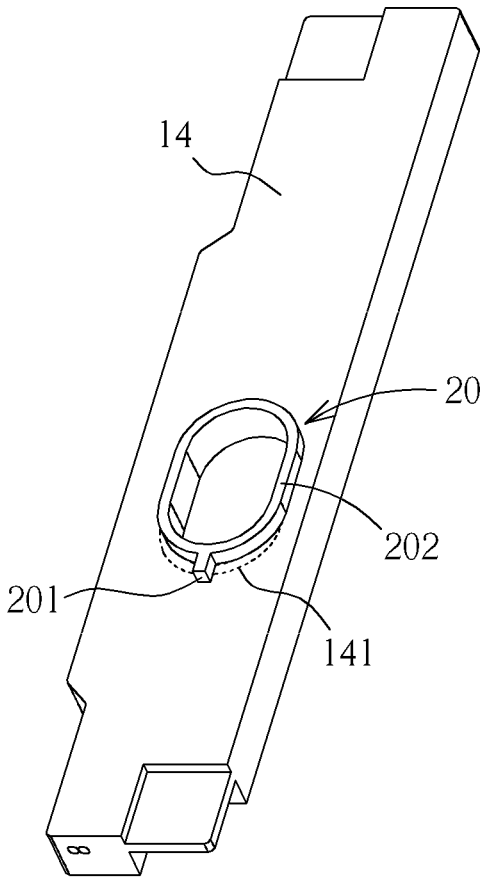
Figure 4:
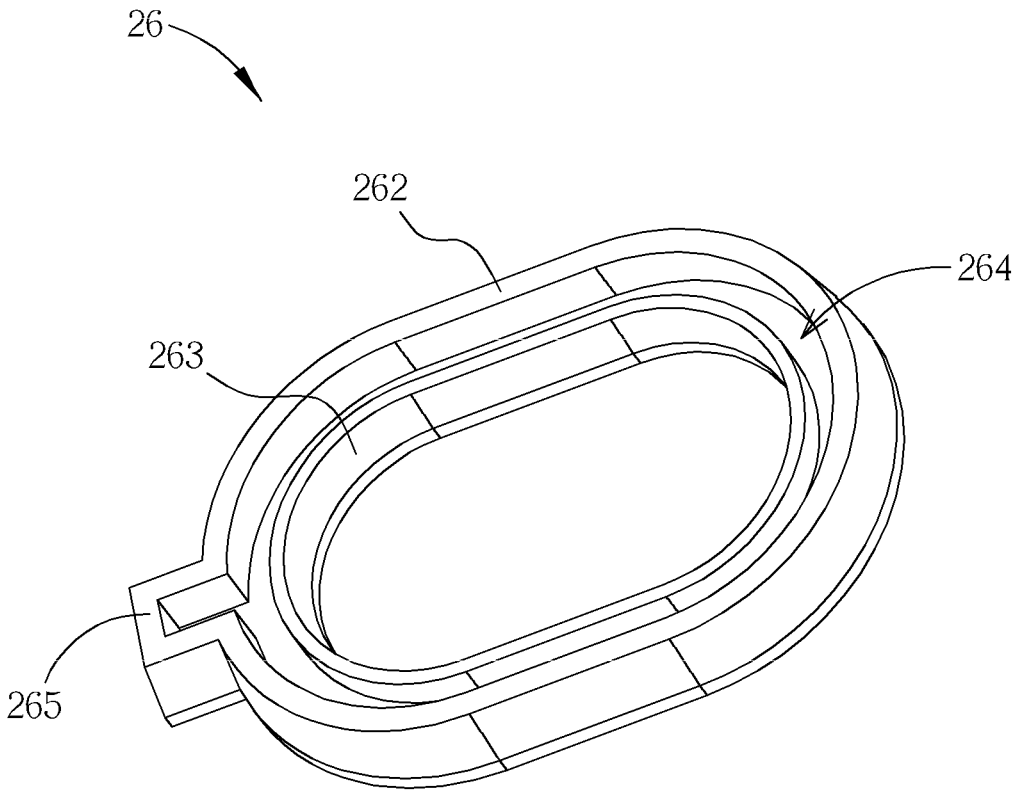
FIG. 4 and FIG. 5 are diagrams of a damping structure in different views according to the embodiment of the present invention.
Figure 5:
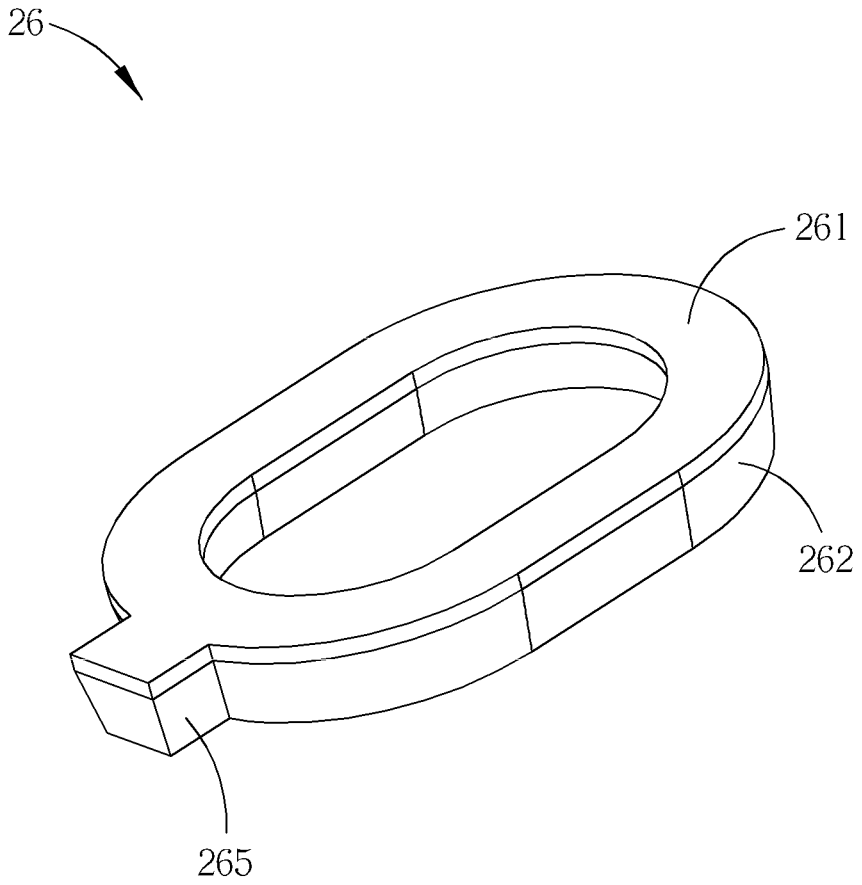

Please refer to FIG. 1 to FIG. 5. FIG. 2 and FIG. 3 are diagrams of the casing 12 and the sound box 14 according to the embodiment of the present invention. FIG. 4 and FIG. 5 are diagrams of the damping structure 26 in different views according to the embodiment of the present invention. The fixing mechanism 16 includes a first bridging structure 20 disposed on the sound box 14 and surrounding the speaker 141, a second bridging structure 22 disposed on the casing 12 and surrounding the sound hole 121, a rib structure 24 disposed on the casing 12, and a damping structure 26 installed between the first bridging structure 20 and the second bridging structure 22. The damping structure 26 is disposed between the casing 12 and the sound box 14 for connecting the first bridging structure 20 and the second bridging structure 22 in a tight fit manner. In addition, the damping structure 26 includes a base 261 for contacting against the rib structure 24, so that the damping structure 26 can tightly contact the rib structure 24 for preventing liquid from leakage. The damping structure 26 further includes an exterior portion 262 disposed on an outer edge of the base 261 for installing inside the second bridging structure 22. The damping structure 26 can be selectively made of resilient material for absorbing the vibration generated from the sound box 14, so as to prevent operation of the other electronic components from damage by the vibration transmitting through the casing 12. Furthermore, the damping structure 26 can tightly contact against the first bridging structure 20 and the second bridging structure 22 for preventing liquid from leakage.

Generally, the exterior portion 262 can be completely disposed inside the second bridging structure 22 for tightly connecting the damping structure 26 to the second bridging structure 22. However, the exterior portion 262 can partly contact against the second bridging structure 22 due to design tolerance, which means that a part of the exterior portion 262 can tightly contact against the second bridging structure 22, and a plurality of gaps can be formed between the second bridging structure 22 and the other part of the exterior portion 262. The application is not limited to the above-mentioned embodiment, and depends on design demand. The damping structure 26 further includes an interior portion 263 disposed on an inner edge of the base 261. An accommodating space 264 is formed between the exterior portion 262 and the interior portion 263 for accommodating the first bridging structure 20. Thus, the damping structure 26 can be for connecting between the first bridging structure 20 and the second bridging structure 22, so as to stably fix the sound box 14 on the casing 12.

Figure 6:
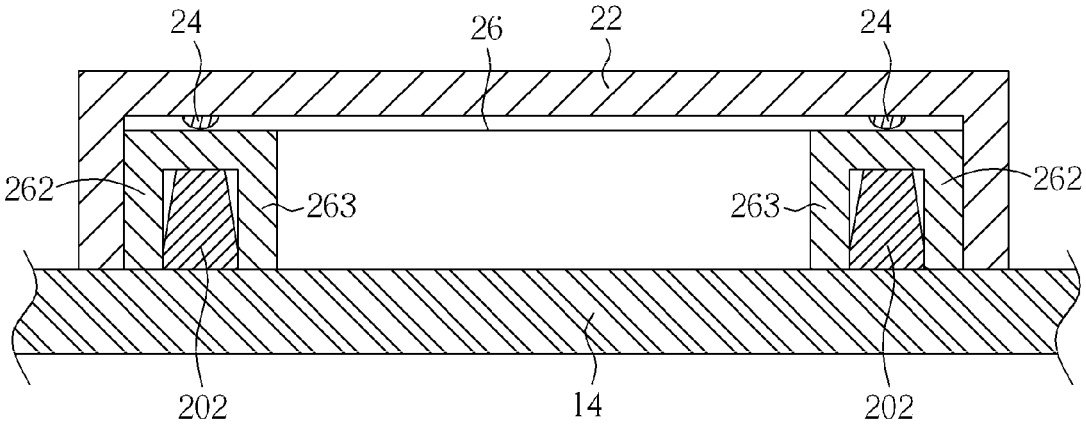
FIG. 6 is a sectional view of a first bridging structure, a second bridging structure and the damping structure according to the embodiment of the present invention.

In addition, the first bridging structure 20 can include a protruding portion 201, and the damping structure 26 can further include a sheathing portion 265 connected to the exterior portion 262. The sheathing portion 265 can be for sheathing the protruding portion 201 of the first bridging structure 20. The second bridging structure 22 can include an accommodating portion 221 for accommodating the sheathing portion 265 of the damping structure 26. Therefore, an assembly of the protruding portion 201, the sheathing portion 265 and the accommodating portion 221 can be an idle-proof structure for ensuring that the damping structure 26 can be accurately connected between the first bridging structure 20 and the second bridging structure 22. Furthermore, the first bridging structure 20 can further include a guiding portion 202 formed on an edge of the first bridging structure 20 protruding from the sound box 14 for increasing structural compactness of the first bridging structure 20 and the damping structure 26. The guiding portion 202 can be an inclined structure. Please refer to FIG. 6. FIG. 6 is a sectional view of the first bridging structure 20, the second bridging structure 22 and the damping structure 26 according to the embodiment of the present invention. When the first bridging structure 20 is disposed inside the accommodating space 264 on the damping structure 26, a part of the guiding portion 202 can contact between the exterior portion 262 and the interior portion 263, so that an outer inclined surface of the damping structure 26 can interfere with an inner surface of the second bridging structure 22, and the first bridging structure 20 can interfere with the exterior portion 262 and the interior portion 263 of the damping structure 26, for preventing the damping structure 26 from separating from the first bridging structure 20 and the second bridging structure 22.

Comparing to the prior art, screws are useless in the fixing mechanism of the present invention. The prevent invention connects the first bridging structure and the second bridging structure to the damping structure for stably fixing the sound box on the casing. Because the fixing mechanism of the present invention is disposed between the sound hole on the casing and the speaker of the sound box, sound generated by the sound box can transmit out of the sound hole on the casing through the first bridging structure, the second bridging structure and the damping structure of the fixing mechanism, so that the fixing mechanism of the present invention can increase sound quality of the electronic device. In addition, the damping structure of the present invention can be a buffer between the sound box and the casing, so as to effectively isolate the vibration generated by the sound box for preventing operation of the other electronic components of the electronic device from damage by the vibration generated by the sound box.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A fixing mechanism, the fixing mechanism being disposed inside an electronic device, the electronic device comprising a casing and a sound box, the sound box comprising a speaker, and a sound hole being formed on the casing, the fixing mechanism comprising:

a first bridging structure disposed on the sound box and surrounding the speaker of the sound box;

a second bridging structure disposed on the casing and surrounding the sound hole on the casing;

a rib structure disposed on the casing; and a damping structure detachably disposed between the first bridging structure and the second bridging structure, the damping structure comprising:

a base for contacting against the rib structure;

an exterior portion disposed on an outer edge of the base for installing inside the second bridging structure; and an interior portion disposed on an inner edge of the base, the first bridging structure being clamped between the exterior portion and the interior portion, an accommodating space being formed between the exterior portion and the interior portion for accommodating the first bridging structure.

2. The fixing mechanism of claim 1, wherein a part of the exterior portion is disposed inside the second bridging structure.

3. The fixing mechanism of claim 1, wherein the first bridging structure comprises a protruding portion, the damping structure further comprises a sheathing portion connected to the exterior portion, and the sheathing portion is for sheathing the protruding portion of the first bridging structure.

4. The fixing mechanism of claim 1, wherein the second bridging structure comprises an accommodating portion, the damping structure further comprises a sheathing portion connected to the exterior portion, and the accommodating portion is for accommodating the sheathing portion of the damping structure.

5. The fixing mechanism of claim 1, wherein the first bridging structure comprises a protruding portion, the second bridging structure comprises an accommodating portion, the damping structure further comprises a sheathing portion connected to the exterior portion, the sheathing portion is for sheathing the protruding potion of the first bridging structure, and the accommodating portion is for accommodating the sheathing portion of the damping structure.

6. The fixing mechanism of claim 1, wherein the first bridging structure comprises a guiding portion, the guiding portion is for partly contacting against the exterior portion and the interior portion when the first bridging structure is accommodated inside the accommodating space.

7. The fixing mechanism of claim 6, wherein the guiding portion of the first bridging structure is an inclined structure.

8. An electronic device comprising:

a casing, a sound hole being formed on a surface of the casing;

a sound box comprising a speaker, sound generated by the speaker transmitting out of the casing via the sound hole; and a fixing mechanism for fixing the sound box on the casing, the fixing mechanism comprising:

a first bridging structure disposed on the sound box and surrounding the speaker;

a second bridging structure disposed on the casing and surrounding the sound hole;

a rib structure disposed on the casing; and a damping structure detachably disposed between the first bridging structure and the second bridging structure, the damping structure comprising:

a base for contacting against the rib structure;

an exterior portion disposed on an outer edge of the base for installing inside the second bridging structure; and an interior portion disposed on an inner edge of the base, the first bridging structure being clamped between the exterior portion and the interior portion, an accommodating space being formed between the exterior portion and the interior portion for accommodating the first bridging structure.

9. The electronic device of claim 8, wherein a part of the exterior portion is disposed inside the second bridging structure.

10. The electronic device of claim 8, further comprising:

a vibration-absorbing component disposed on the sound box.

11. The electronic device of claim 8, wherein the first bridging structure comprises a protruding portion, the damping structure further comprises a sheathing portion connected to the exterior portion, and the sheathing portion is for sheathing the protruding portion of the first bridging structure.

12. The electronic device of claim 8, wherein the second bridging structure comprises an accommodating portion, the damping structure further comprises a sheathing portion connected to the exterior portion, and the accommodating portion is for accommodating the sheathing portion of the damping structure.

13. The electronic device of claim 8, wherein the first bridging structure comprises a protruding portion, the second bridging structure comprises an accommodating portion, the damping structure further comprises a sheathing portion connected to the exterior portion, the sheathing portion is for sheathing the protruding potion of the first bridging structure, and the accommodating portion is for accommodating the sheathing portion of the damping structure.

14. The electronic device of claim 8, wherein the first bridging structure comprises a guiding portion, the guiding portion is for partly contacting against the exterior portion and the interior portion when the first bridging structure is accommodated inside the accommodating space.

15. The electronic device of claim 14, wherein the guiding portion of the first bridging structure is an inclined structure.

* * * * *